US009851180B2

(12) United States Patent
Ley

(10) Patent No.: US 9,851,180 B2
(45) Date of Patent: Dec. 26, 2017

(54) FIREARM ACCESSORY LOCKING STRUCTURE

(71) Applicant: Ryan M. Ley, Wilmington, NC (US)

(72) Inventor: Ryan M. Ley, Wilmington, NC (US)

( * ) Notice: Subject to any disclaimer, the term of this patent is extended or adjusted under 35 U.S.C. 154(b) by 0 days.

(21) Appl. No.: 15/235,559

(22) Filed: Aug. 12, 2016

(65) Prior Publication Data

US 2016/0349013 A1 Dec. 1, 2016

Related U.S. Application Data

(63) Continuation-in-part of application No. 14/949,428, filed on Nov. 23, 2015, now abandoned, and a continuation-in-part of application No. 14/555,875, filed on Nov. 28, 2014.

(51) Int. Cl.
*F41A 15/00* (2006.01)
*F41G 11/00* (2006.01)

(52) U.S. Cl.
CPC ..... *F41G 11/003* (2013.01)

(58) Field of Classification Search
CPC ..... F41G 11/003
USPC ..... 42/90
See application file for complete search history.

(56) References Cited

U.S. PATENT DOCUMENTS 4,532,729 A * 8/1985 Von Muller ..... F41A 17/02 42/70.11
5,065,538 A * 11/1991 Allen ..... F41G 1/42 42/142
5,092,071 A * 3/1992 Moore ..... F41G 1/35 42/105
6,487,807 B1 * 12/2002 Kopman ..... F41A 23/12 42/72
6,574,901 B1 * 6/2003 Solinsky ..... F41G 11/003 362/110
6,641,277 B2 11/2003 Smith
7,191,557 B2 3/2007 Gablowski
7,240,452 B2 7/2007 Ho
7,312,434 B1 12/2007 Helstern
7,574,810 B1 8/2009 Lorocco
7,712,241 B2 5/2010 Teetzel
7,739,824 B1 6/2010 Swan
7,770,317 B1 * 8/2010 Tankersley ..... F41C 23/16 42/71.01
9,310,165 B2 4/2016 Bell
9,341,438 B2 * 5/2016 Larson, Jr. ..... F41C 23/16
9,464,865 B2 * 10/2016 Shea ..... F41C 23/16
9,671,198 B2 * 6/2017 Bartoszewicz ..... F41G 11/003
(Continued)

*Primary Examiner* — Samir Abdosh
(74) *Attorney, Agent, or Firm* — Russell D. Nugent

(57) ABSTRACT

A locking mechanism for a firearm accessory that is meant to be attached to the rail system of a firearm such as a pistol. The locking mechanism features a locking screw that can either be a set screw or a jam socket screw that is advanced within a bore housed by the device until the screw contacts and raises a platform featuring a protrusion configured to engage with a rail system on a firearm frame. The device can also feature a spring located between the locking screw and the platform that can be used to keep tension on the platform. In addition, the device can feature a thumbscrew that is used to advance the locking screw within the device's bore. The locking device is attached to the firearm and screwed into place, but has to be removed through the use of a separate tool.

11 Claims, 3 Drawing Sheets

(56) References Cited

U.S. PATENT DOCUMENTS

| | | | | |
|---|---|---|---|---|
| 2004/0055202 | A1* | 3/2004 | Oz | F41G 1/35 42/146 |
| 2004/0060222 | A1 | 4/2004 | Oz | |
| 2005/0188588 | A1 | 9/2005 | Keng | |
| 2005/0241206 | A1* | 11/2005 | Teetzel | F41C 23/16 42/72 |
| 2006/0064913 | A1 | 3/2006 | Gablowski | |
| 2007/0107292 | A1 | 5/2007 | Bar-Yona et al. | |
| 2007/0271832 | A1* | 11/2007 | Griffin | F41C 23/16 42/72 |
| 2009/0133309 | A1 | 5/2009 | Cahill | |
| 2011/0061283 | A1 | 3/2011 | Cavallo | |
| 2011/0167703 | A1* | 7/2011 | Deros | F41G 11/003 42/90 |
| 2011/0179688 | A1* | 7/2011 | Ash, Jr. | F41C 23/16 42/72 |
| 2012/0124885 | A1 | 5/2012 | Caulk et al. | |
| 2013/0205638 | A1 | 8/2013 | Herring | |
| 2015/0143734 | A1* | 5/2015 | Ley | F41A 35/00 42/146 |
| 2015/0316347 | A1* | 11/2015 | Shea | F41C 23/16 42/75.02 |
| 2016/0349013 | A1* | 12/2016 | Ley | F41G 11/003 |

* cited by examiner

FIREARM ACCESSORY LOCKING STRUCTURE

CROSS-REFERENCE TO RELATED APPLICATIONS

This application claims the benefit of priority to and is a continuation in part of U.S. application Ser. No. 14/555,875 filed on Nov. 28, 2014. The content of U.S. application Ser. No. 14/555,875 filed on Nov. 28, 2014 is incorporated by reference herein in its entirety. This application also claims the benefit of priority to and is a continuation in part of U.S. application Ser. No. 14/949,428 filed on Nov. 23, 2015. The content of U.S. application Ser. No. 14/949,428 filed on Nov. 23, 2015 is incorporated by reference herein in its entirety.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

BACKGROUND OF THE INVENTION (a) Field of the Invention

The device described in this application is a locking mechanism for accessories that may be attached to firearms. More specifically, this application describes a mechanism that is used to stabilize an accessory that is attached to the frame of a firearm.

(b) Background Art

There are a variety of firearm accessories already in existence that are designed to releasably attach to a firearm so that the operator of the firearm can use both the accessory and the weapon at roughly the same time. For example, weapon mounted lights are used in conjunction with a firearm to aid low light target identification, allowing the user to simultaneously aim and illuminate the target. These lights can be handheld or mounted to the weapon, with the light beam parallel to the bore. Such lights are commonly used by officers of tactical agencies such as military, government, local, state and federal agencies in the field and for training during daylight, low and/or no light conditions. Weapon mounted lights are mounted on rifles, shotguns, submachine guns and handguns. These lights offer hands-free use, leaving the operator free to use both hands to control the weapon.

Generally, firearm accessories attach to some portion of the frame of the firearm and may have a second component that stabilizes the accessory by engaging with a discrete part of the firearm frame or rail system. For example, in U.S. patent application Ser. No. 14/949,428 this inventor has disclosed a system for attaching a firearm accessory to a firearm using a rail system integrated into the handgun frame. The accessory has two rails that are substantially parallel and are complementary to two substantially parallel rails that are located on the frame of a firearm. The device is fitted onto the rail system of a firearm and the locking mechanism is engaged with a perpendicular impression that is located between the parallel rails on the forearm frame. The device features a thumb screw that allows the user to easily tighten or loosen the accessory on the firearm frame.

However, in making these devices easy to attach and detach, manufacturers have made the devices easier to lose especially during training exercises. In this inventor's personal and professional experience, live fire training that does not also simulate the use of the firearm mounted accessory does not adequately prepare individuals for using their firearms in real life combat situations. In other words, without the proper training, the average firearms operator will draw and fire their weapon considerably more slowly when their firearm has an accessory attached to it as compared to how fast they draw and fire the same weapon without the accessory attached. The use of firearm accessories during training exercises also gives the user an opportunity to take the accessory off of the firearm and to lose it. Moreover, there are opportunities for the attachment means of the accessory to become loose and to disengage from the firearm.

As a result, there is a need in the firearms industry for an accessory that can be easily and releasably mounted to a firearm and that allows the user to lock the accessory onto the firearm so that the user cannot easily disengage and separate the accessory from the firearm.

BRIEF SUMMARY OF THE INVENTION

The device described in this application is an inexpensive and sturdy mechanism that can be used to lock an accessory on a firearm. The device is meant to be used with both actual or real and functional firearm accessories as well as dummy, replica or artificial accessories that merely simulate the look and feel of a functioning firearm accessory.

One of the preferred embodiments of the presently disclosed device is designed to work with an artificial or replica firearm accessory with a body having a bore extending through the inner diameter of the firearm accessory body. While the bore could simply be a hole extending through the interior and exterior of the accessory body, in a preferred embodiment of the device, the interior of the bore features threads. The locking mechanism further features a locking screw inserted into the bore. A preferred embodiment of the device features threads on the exterior of the locking screw that are complementary to the threads on the interior of the bore. As a result, in preferred embodiments of this device the locking screw can be threaded into the bore. In addition, preferred embodiments include a second screw, ideally a thumb screw, positioned at one end of the bore with a screw body that passes through the bore to contact the locking screw. When the user turns the thumb screw, the tip of the thumb screw engages the locking screw causing it to turn in the bore in which it is situated. Thus the user can use the thumb screw to advance the locking screw until it contacts another structure located at or within the bore.

In the preferred embodiments of this device, at that opposite end of the bore, there is a platform featuring a raised ridge that is shaped to engage a corresponding portion of the firearm frame. As a result, when the user turns the thumb screw, the user causes the locking screw to advance in the bore of the device until the locking screw contacts the undersurface of the platform. Alternately, the locking screw can be used to contact and compress a spring positioned between the tip of the locking screw and the underside of the platform. Further turning the thumb screw causes the platform to move from a first retracted position to a second extended position. The unique functioning of this device is a result of the locking screw that, once advanced in the bore sufficiently to cause the platform to raise into its extended position, then stays in place until or unless the user uses a separate tool to loosen the locking screw. The user thereby locks the accessory onto the firearm frame preventing the user from removing the accessory from the firearm by simply turning the thumb screw in the opposite position.

DETAILED DESCRIPTION OF THE INVENTION

Figure 1:
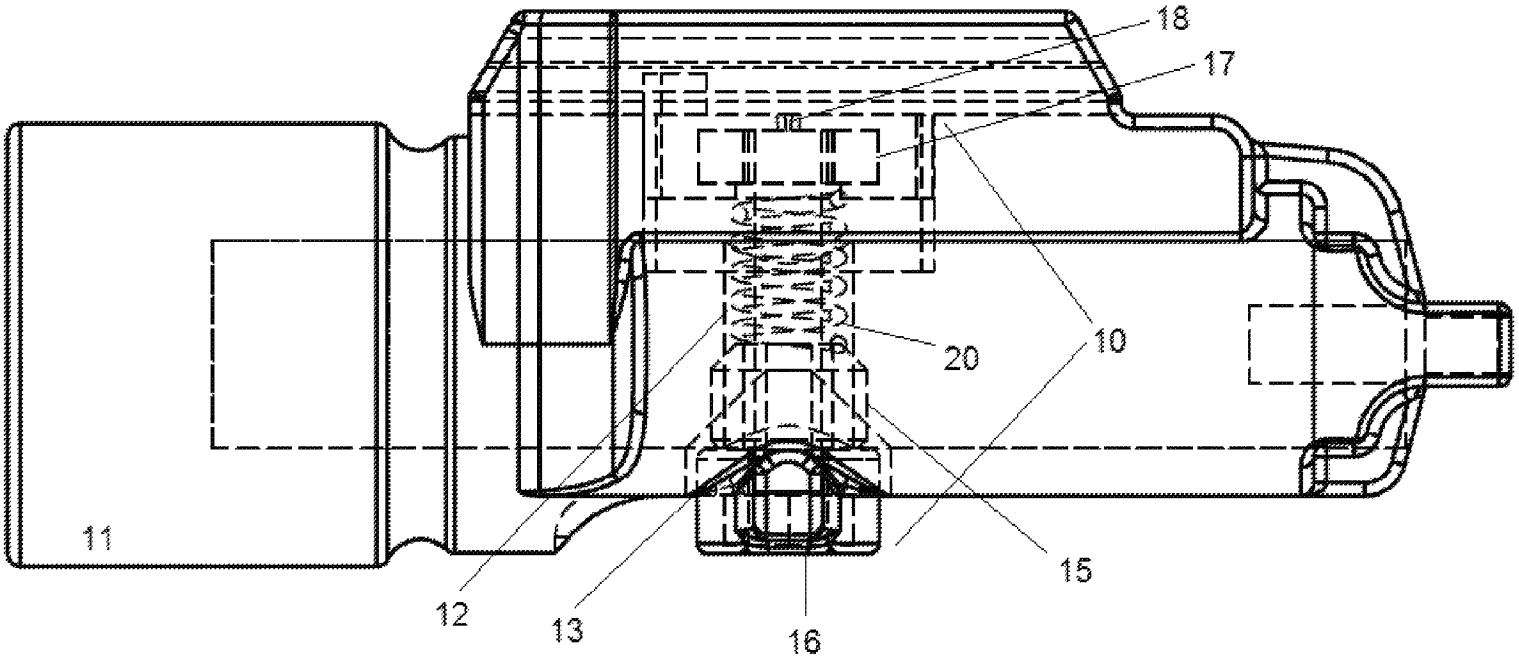
FIG. 1 is an x-ray side view of a firearm accessory featuring the locking mechanism.

Referring now to the invention in more detail, in FIG. 1 there is shown an x-ray view of a firearm accessory featuring the locking mechanism, generally 10. The firearm accessory has a rigid body 11 featuring a bore 12 that passes completely through the interior and exterior of the body 11 such that each end of the bore 12 is accessible from the outside of the accessory. The bore 12 has a first end 13 and a second end 14. The locking mechanism 10 also features a locking screw 15 that is inserted in the first end 13 of the bore 12. In one preferred embodiment, the locking screw 15 is a set screw. In other preferred embodiments, the locking screw 15 is a jam socket screw. For convenience, when the various embodiments of this device are discussed, the term "locking screw" will be used and is meant to refer to a set screw, a jam socket screw and/or their functional and structural equivalents.

In addition, the locking mechanism 10 includes a screw 16 that is inserted into the first end 13 of the bore 12 after the locking screw 15 is placed into the bore 12. In the preferred embodiment and best mode of this device, the screw 16 is a thumb screw. The locking mechanism also includes a platform 17 with a raised edge or protrusion 18 that is placed over the second end 14 of the bore 12. Moreover, in the preferred embodiment and best mode of the locking mechanism 10, the platform features a hole 19 that is comparable in diameter to the diameter of the bore 12. Also, the preferred embodiment of the locking mechanism 10 includes a spring 20 inserted into the bore 12 from the second end 14 of the bore 12, such that it is located immediately underneath the platform 17.

The locking mechanism 10 in FIG. 1 is assembled by inserting or threading the locking screw 15 into the first end 13 of the bore 12. Next the thumb screw 16 is threaded into the first end 13 of the bore 12. As previously discussed, in preferred embodiments of the locking mechanism 10, the set screw 15 has external threads (not shown) that are complementary to threads lining the interior of the bore 12. In addition, the exterior surface of the thumb screw 16 also features threads (not shown) that are complementary to the threads lining the interior of the bore 12. The spring 20 can be inserted into the bore from either end, but generally a user will insert the spring 20 into the bore 12 from the second end 14 of the bore 12, after the locking screw 15 and thumb screw 16 are inserted into the first end 13 of the bore 12. Once the spring 20 is in place, the platform 17 is seated over the second end of the bore. By tightening the thumb screw 16, the user can cause the locking screw 15 to advance or thread further into the bore 12 to contact and compress the spring 20 between the platform 17 and the locking screw 15 thereby applying upward force to the bottom surface of the platform 17. This upward force will help keep the platform 17 featuring the protrusion 18 flush against the firearm frame until the locking screw is loosened.

In more detail, the diameter of the threaded portion of the thumb screw 16 has to be similar enough to the diameter of the bore 12 such that the thumb screw can be snugly threaded into the bore 12. This necessarily means that the diameter of the hole 21 in the locking screw 15 must be smaller than the diameter of the thumb screw 16 and the bore 12. Otherwise, it would be impossible to use the thumb screw 16 to thread the locking screw 15 into the bore 12.

Figure 2:
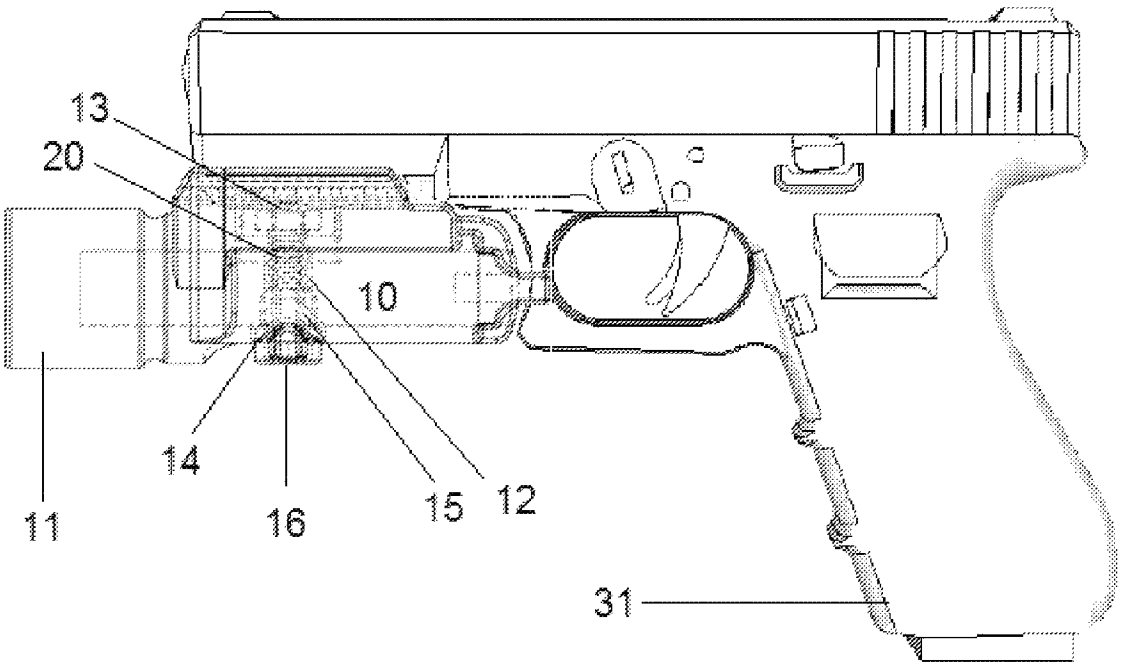
FIG. 2 is an x-ray side view of a firearm accessory featuring the locking mechanism.

Referring now to the invention in more detail, FIG. 2 shows an x-ray view of a firearm accessory, generally 30, featuring the locking mechanism 10 attached to the frame of a firearm 31. Generally, a firearm accessory 30 will have a primary means of attaching to the firearm and a secondary means of attachment meant to stabilize the accessory once it is attached using the primary means. For example, as previously discussed, there are a variety of rail systems that are commonly used to attach accessories to firearm frames. Firearm accessories that are designed to be attached to these rail systems have structures on their outer surfaces that are meant to be complementary to the rails and allow the firearm to attach to the rail system. Such a system has been disclosed by this inventor in U.S. patent application Ser. No. 14/949,428. The locking mechanism 10 disclosed herein is meant to complement or replace the secondary means of attachment that stabilize the accessory on the firearm frame. More specifically, once the accessory 30 is attached to the rails of the firearm 31, the thumbscrew 16 is turned and thus turns the locking screw 15 and advances it upwards in the bore 12 towards the spring 20 and platform (not shown). As the locking screw 15 advances into the bore 12, it compresses the spring 20 and provides tension that forces the platform against the firearm frame securing the accessory to the firearm 31. Alternately, the device can work without the spring 20. In such embodiments, the locking screw 15 contacts the underside of the platform (not shown) and engages the platform directly.

Once the locking screw 15 is securely engaged with the spring 20 and/or the platform 17, the thumbscrew 16 can be removed from the device without the locking screw 15 being loosened or repositioned. Thus, the platform 17 featuring the protrusion stays in place, engaged with the frame of the firearm 31. This can be an advantage in training scenarios in which the instructor does not want the user to be able to accidentally or intentionally remove the accessory from the firearm. Even with the thumbscrew 16 removed, the locking screw 15 is held securely in place by the complementary threading on the locking screw and the interior of the bore 12.

As noted, the thumbscrew 16 advances the locking screw 15 into the bore 12, but in the preferred embodiment, the thumb screw 16 does not attach to the locking screw 15 such that when the thumb screw 16 is unthreaded, removed or backed out of the device, it does not unthread, remove or back out the locking screw 15. As a result, to remove the accessory 30 from the firearm 31, the user must insert a tool into the bore 12 to turn the locking screw 15 such that it disengages with the threads inside the bore 12. As the locking screw 15 is backed out of the bore 12, it ceases to apply force to the platform 17 or the spring 20 and the platform in turn ceases to be engaged with the frame 31 of the firearm 30. As previously mentioned, preferred embodiments of this device can use different structures as the locking screw 15. In one embodiment, the locking screw 15 is a set screw with a screw drive that is shaped to fit a standard tool such as a screw driver. In this embedment, the user will remove the thumb screw 16 and then insert the tip of a screw driver or similar tool into the screw drive (not shown) of the set screw 15, allowing the user to turn the set screw such that it backs out of the bore 12. Alternately, the locking screw 15 can be a jam socket screw with a hole 21 in its center that can accommodate a hex key, Allen Key or Allen Wrench or other tool that can be used to turn or unscrew the screw and remove it from the bore 12. In this embodiment, the user will still likely remove the thumb screw 16 before trying to "unlock" the device. The user can then insert a tool such as an Allen wrench into either the first end 13 of the bore 12 or the second end 14 of the bore through the hole 19 in the platform 17. The tool can be used to engage the hole 22 in the jam socket screw 15 thus allowing the user to turn the jam socket screw 15 and remove it from the bore 12 altogether or simply to reposition it within the bore 12 so that it can be later used to lock the accessory 30 onto the same or a different firearm 31.

Figure 3:
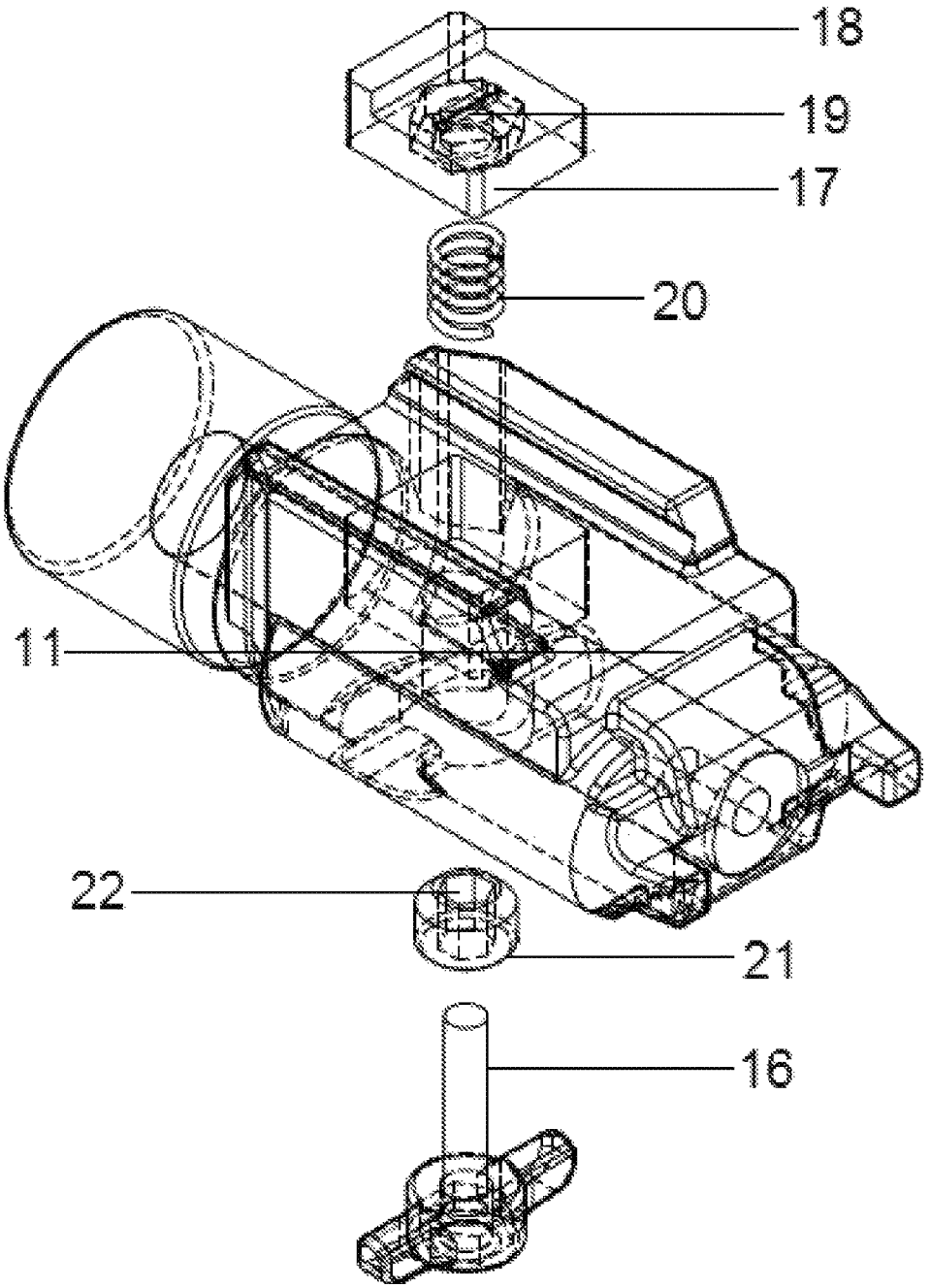
FIG. 3 is an exploded view of a firearm accessory featuring the locking mechanism.

FIG. 3 is an exploded view of a firearm accessory featuring the embodiment of the locking mechanism 10 using a socket jam screw 21. The locking mechanism 10 in FIG. 3 is assembled by inserting or threading the socket jam screw 21 into the first end 13 of the bore 12. Next the thumb screw 16 is threaded into the first end 13 of the bore 12. The spring 20 can either be inserted into the first end 13 of the bore 12 prior to inserting the set or socket jam screw 15 into the first end 13 of the bore 12, or it can be inserted into the second end 14 of the bore 12 prior to positioning the platform 17. Once the spring 20 is in place, the platform 17 is seated over the second end 14 of the bore 12. By tightening the thumb screw 16, the user can cause the set screw or socket jam screw 15 to advance or thread further into the bore 12 to contact and compress the spring 20 between the platform 17 and the jam socket screw 15 thereby applying upward force to the bottom surface of the platform 17.

A skilled artisan will appreciate that the various components of this system can be made from a variety of materials, including metals, fiberglass and durable plastics and polymers. In addition, the tip of the thumb screw 16 can be machined as can the head of the locking screw 15 to make the two structures engage each other more firmly making it easier to use the thumb screw 16 to screw or unscrew the set screw 15.

Reference throughout the specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout the specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

It is understood that the above described embodiments are only illustrative of the application of the principles of the present invention. The present invention may be embodied in other specific forms without departing from its spirit or essential characteristics. The described embodiment, including the best mode, is to be considered in all respects only as illustrative and not restrictive. The scope of the invention is, therefore, indicated by the appended claims, if any, in conjunction with the foregoing description.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

I claim:

1. A locking mechanism for a firearm accessory comprising:

a first screw with an external surface featuring threads, a bore having a first end and a second end, said bore extending through an interior and an exterior of the firearm accessory and said bore having an interior surface that features threads that are complementary to the threads on the external surface of the first screw, a platform featuring a raised protrusion; wherein the first screw is inserted into a first end of the bore and the platform is positioned at the second end of the bore; and a second screw, featuring external threads that are complementary to the threads featured on the interior of the bore, inserted into the first end of the bore whereby turning the second screw causes the first screw to advance in the bore towards the platform.

2. The locking mechanism of claim 1 further comprising a spring positioned in the bore between the first screw and the platform.

3. The locking mechanism of claim 1 wherein the first screw is a set screw.

4. The locking mechanism of claim 2 where in the first screw is a set screw.

5. The locking mechanism of claim 1 wherein the first screw is a jam socket screw.

6. The locking mechanism of claim 2 where in the first screw is a jam socket screw.

7. A locking mechanism for a firearm accessory comprising:

a first screw with an external surface featuring threads, a bore having a first end and a second end, said bore extending through an interior and an exterior of the firearm accessory and said bore having an interior surface that features threads that are complementary to the threads on the external surface of the first screw, a platform featuring a raised protrusion; wherein the first screw is inserted into a first end of the bore and the platform is positioned at the second end of the bore, a second screw, featuring external threads that are complementary to the threads featured on the interior of the bore, the second screw being inserted into the bore opposite the platform, a spring positioned in the bore between the first screw and the platform;

wherein when the second screw is turned, the second screw contacts and advances the first screw in the bore towards the platform thereby causing the platform to raise from a first retracted position to a second raised position in which the protrusion on the platform engages a portion of a firearm frame.

8. The locking mechanism of claim 7 wherein the first screw is a set screw.

9. The locking mechanism of claim 7 wherein the first screw is a jam socket screw.

10. A method of locking a firearm accessory, having a bore extending through an interior and an exterior of the firearm accessory, onto a firearm comprising:

inserting a first screw into a first end of the bore, positioning a platform featuring a raised edge at a second end of the bore, inserting a second screw into the first end of the bore, raising the platform with the protrusion by turning the second screw thereby advancing the first screw inside the bore until it engages the platform and raises the platform until the protrusion engages a portion of a frame of a firearm.

11. The method of claim 10 further comprising the steps of:

positioning a spring in the bore between the first screw and the platform, the spring being compressed when the second screw is turned advancing the first screw in the bore towards the spring and the platform, thereby biasing the platform upwards such that the protrusion engages a portion of a frame of a firearm.

* * * * *